US005297589A

United States Patent [19]

Baumann

[11] Patent Number: 5,297,589

[45] Date of Patent: Mar. 29, 1994

[54] HEDDLE FRAME WITH DETACHABLE CORNER CONNECTIONS

[75] Inventor: Hans Baumann, Horgen, Switzerland

[73] Assignee: Grob & Co. Aktiengesellschaft, Horgen, Switzerland

[21] Appl. No.: 916,114

[22] PCT Filed: Nov. 26, 1991

[86] PCT No.: PCT/CH91/00240

§ 371 Date: Jul. 30, 1992

§ 102(e) Date: Jul. 30, 1992

[87] PCT Pub. No.: WO92/09730

PCT Pub. Date: Jun. 11, 1992

[30] Foreign Application Priority Data

Dec. 1, 1990 [DE] Fed. Rep. of Germany ..... 4038384

[51] Int. Cl.[5] ..... D03C 9/06

[52] U.S. Cl. ..... 139/91; 139/92; 403/231

[58] Field of Search ..... 403/231, 230; 139/91, 139/92

[56] References Cited

U.S. PATENT DOCUMENTS 3,335,759 8/1967 Koch ..... 139/91
4,015,638 4/1977 Graf .
4,355,667 10/1982 Shimizu .
4,741,367 5/1988 Kitawaki ..... 139/91
4,901,767 2/1990 Koch .
5,004,019 4/1991 Blontnock ..... 139/91

*Primary Examiner*—Andrew M. Falik
*Attorney, Agent, or Firm*—Watson, Cole, Grindle & Watson

[57] ABSTRACT

In a heddle frame with detachable corner connections each heddle support has a horizontal projection extending into a cavity of the frame stave and is clamped in place with the use of set screws. The frame stave is constructed of stable longitudinal bands and very thin side walls interconnected as by welding. A rigid insert is inserted at opposite ends of the hollow frame stave, the insert comprising spaced, parallel and longitudinal extending support blocks lying parallel to the longitudinal bands of the frame stave, and reinforcing walls connected to the support blocks, the walls having a wall thickness about 3 to 6 times greater than that of the thin side walls of the frame stave. The thin side walls are securely interconnected as by welding to the surfaces of the reinforcing walls of the insert such that the forces which are generated during the weaving operation and are to be transferred from the lateral supports to the frame stave are transmitted as pulling forces to the thin frame stave side walls of the inserts. The reinforcing walls and the thin side walls of the frame stave are stressed only under tension such that the thin side walls will not bulge despite their thin wall thickness. The projection on each lateral support is clamped only between the support blocks of the insert.

10 Claims, 2 Drawing Sheets

HEDDLE FRAME WITH DETACHABLE CORNER CONNECTIONS

BACKGROUND OF THE INVENTION

This invention relates generally to a heddle frame with detachable corner connections between the opposed lateral supports and the hollow frame stave, the lateral supports each having a projection extending into the hollow frame stave and being securely clamped thereto by set screws.

A heddle frame with detachable corner connections is disclosed in German Patent No. 37 02 524 which has the advantage that it is very stable and can be quickly disconnected if the heddle frame in the weaving mill needs to be disassembled and again reassembled. The frame staves of the heddle frames are usually made of sections of different materials such as aluminum, fiber-reinforced plastic or steel. Attachment of the lateral supports by use of set screws supported on the frame and bearing against a Projection extending from the each lateral support is made possible for known constructions since the wall thickness of the frame stave used is sufficiently strong to facilitate the clamping by the set screws.

Advancement of technology has made it presently possible to construct increasingly wider weaving machines, which also run at higher speeds, wherein the oscillating heddle frames are subjected to very high stress. Thus, for heddle frames made of a light metal a suitably thicker wall thickness must be selected for the hollow section of the frame staves, in order to ensure the requisite flexural strength under high stress. Since this leads to an increase in weight and to a correspondingly necessary increase in power consumption and since, on the other hand, for a high number of load changes the fatigue strength for completely reversed bending stress of the light steel metal used for the profiles is less than that of steel, which has significantly better properties regarding fatigue strength for completely reversed bending stress, one has again switched back to using steel for heddle frames, but using a very thin wall material since the steel weighs more than the light metal. Therefore, such a steel frame stave is assembled by welding together very thin side walls having a wall thickness of less than 0.5 mm and stable, longitudinal bands or support elements. And, a core made of very light material such as a foam material which assures that the thin side walls remain flat, is located in the cavity of this sandwich construction. However, for a frame stave having very thin side walls the corner connections as aforedescribed, using set screws bearing against the projections extending from the lateral supports, fails.

U.S. Pat. No. 3,335,759 discloses reinforced regions of the frame staves for accommodating the lateral support projection, but the connection between the reinforcing elements and the frame stave is designed in such a manner that only a localized introduction of force takes place during which tilting, bulging and the like on the side walls in the region of the conner connections is not reliably prevented.

SUMMARY OF THE INVENTION

It is therefore an object of the present invention to provide a heddle frame stave which may be of steel and having thin side walls to facilitate the mounting of the corner connections with simple set screws or the like.

According to the invention the frame stave has thin side walls interconnected by longitudinally extending support elements or bands, and a hollow rigid insert defining a cavity is inserted into the hollow frame stave at opposing lateral ends. The lateral support projections extend into the cavity openings of the inserts, and set screws on the frame stave are provided for clamping the projections in place. The insert has opposed surface areas connected to the confronting surface areas of the side walls of the frame stave for transmitting pull or thrust forces generated during the weaving operation from the lateral supports to the frame stave via the thin side walls and for generating an expanded thrust area along the longitudinal direction of the support elements or bands.

The insert may be in the form of a rectangular housing having a pair of spaced, parallel and longitudinally extending support blocks lying parallel to the support elements, and a pair of spaced reinforcing walls connected to the blocks. One of the blocks has a threaded bore hole to receive a set screw which clamps each lateral support projection against the other support block of the insert.

If at least a portion of the reinforcing walls of the insert is firmly connected, preferably by welding, to the thin side walls of the frame stave, the forces which are generated in the weaving operation and are to be transferred from the lateral supports into the frame stave, are passed as pull forces to the thin side walls of the frame stave. The thin side walls of the frame stave, which are firmly connected with its total area or, less than its total area, to the reinforcing walls of the insert, therefore cannot bulge, as would occur without such a securely connected insert.

Regarding the forces generated with such a frame stave in the weaving operation the upper and lower longitudinal support elements of the frame stave are referred to as bands and the thin side walls are referred to as thrust fields, which can absorb a very high load, when the objective is reached that they remain totally flat or cannot bulge, a feature that is effected by the construction according to the invention. The thin side walls of the frame stave which are stressed only under tension are thus capable of distributing the generated large forces uniformly over the longitudinal bands of the frame stave.

DETAILED DESCRIPTION OF THE INVENTION

Figure 1A:
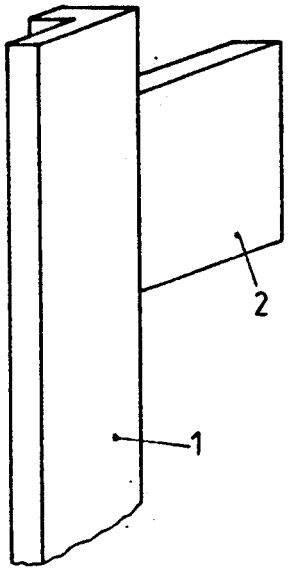
FIGS. 1*a* and 1*b* are fragmentary views, in perspective, of a first embodiment of a lateral support with its projection extendable into a hollow frame stave of a heddle frame, prior to assembly.

FIG. 1*a* illustrates one of an opposing pair of lateral supports 1, 1' having a horizontally extending projection 2 which, when assembled extends into cavity 3 of frame stave 4 (FIG. 1*b*) to effect a corner connection by means of set screws 5 (only one shown in FIG. 1*b*) provided to clamp the lateral supports in place. This known type of corner connection is suitable for a frame stave made of a light metal hollow section.

Figure 1B:
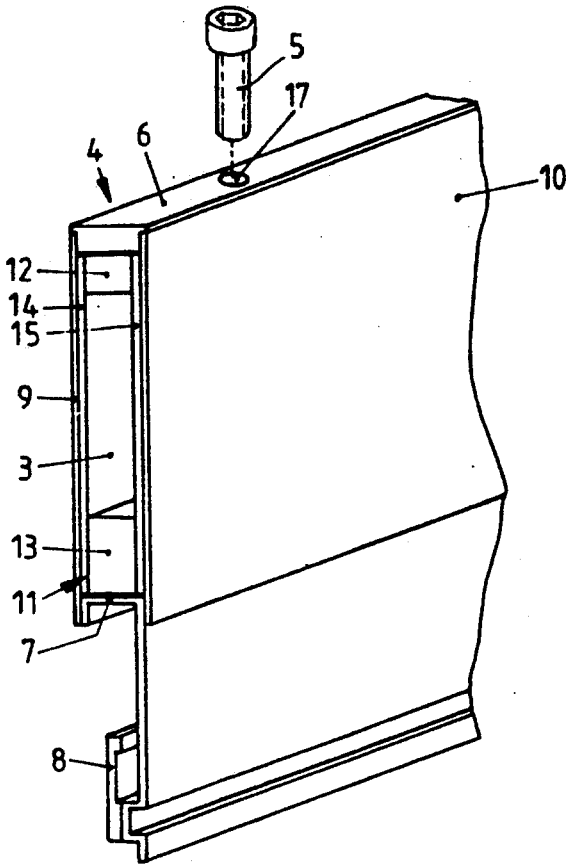

According to the invention frame stave 4 of FIG. 1*b* may be constructed of connected steel parts. The frame stave has an upper longitudinal band or support element 6, a downwardly bent longitudinal band or support element 7 which supports heddle slide bar 8, and very thin opposed and spaced side walls 9 and 10 which are attached to longitudinal bands 6 and 7. These parts may be interconnected by laser welding.

Figure 2A:
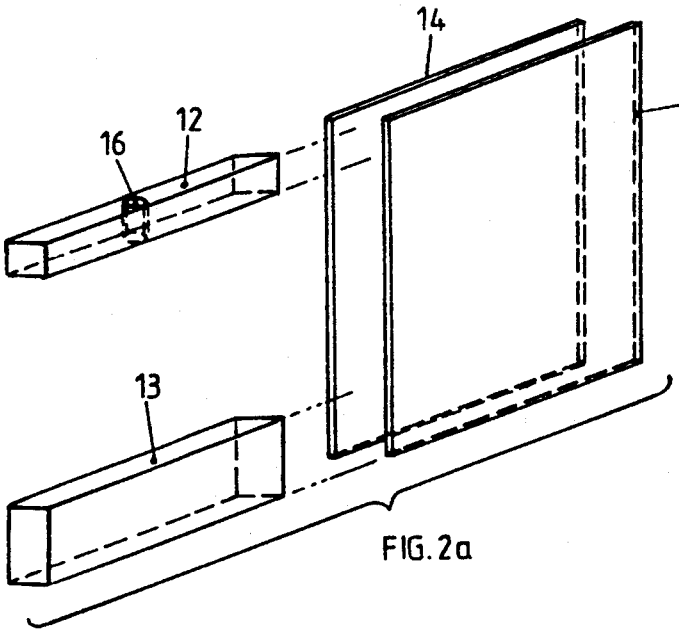
FIG. 2*a* is a schematic drawing, in perspective, of the individual elements of the insert provided for the frame stave.
Figure 2B:
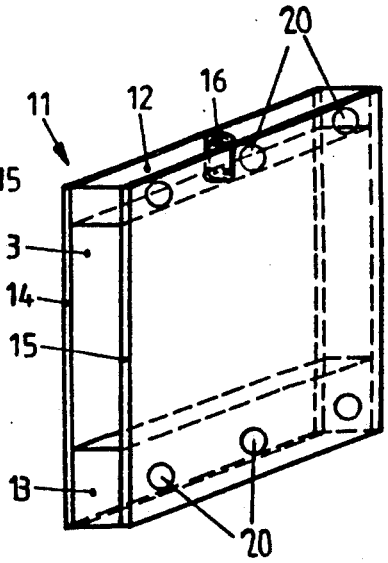
FIG. 2*b* is a view similar to FIG. 2*a* showing the insert assembled together of the individual elements.
Figure 3A:
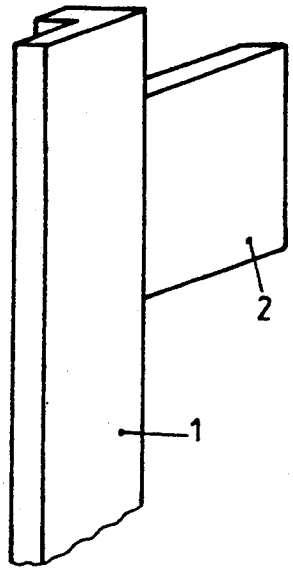
FIGS. 3*a* and 3*b* are views similar to FIGS. 1*a* and 1*b* of another embodiment according to the invention.
Figure 3B:
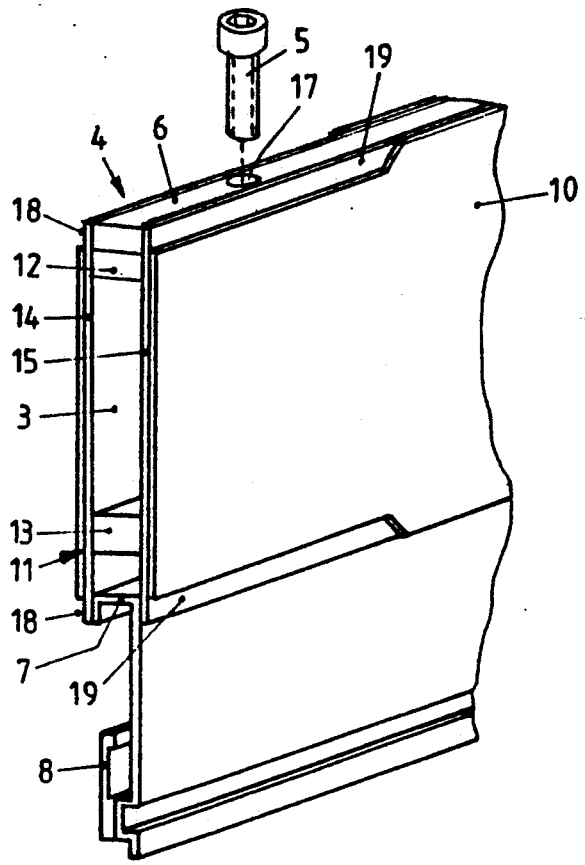
Figure 4A:
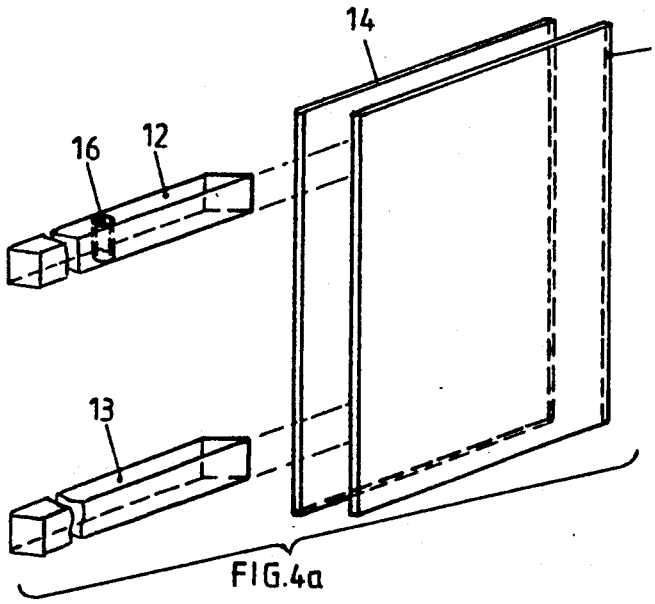
FIGS. 4*a* and 4*b* are views similar to FIGS. 2*a* and 2*b* of another embodiment of a rigid insert according to the invention.
Figure 4B:
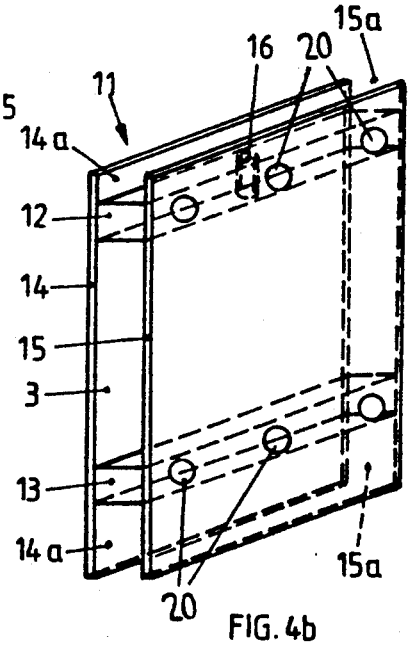

Between side walls 9 and 10 the cavity of the frame stave, with the exception of the end regions that are to be maintained open for the reception of the corner connections, is filled with a core which may be a foam material (not shown). The thin side walls, having a thickness of about 0.5 mm or below, are adhesively secured to the core so that the side walls remain flat A rigid insert 11 (FIG. 2*b*) is arranged at opposite ends of the hollow frame stave (only one end being shown in FIG. 1*b*) to pass the forces generated during the weaving operation and to be transferred from the lateral support into the frame stave as tensional forces via the thin frame stave side walls 9 and 10. As shown in FIG. 2*a*, this insert has an upper support block 12 extending parallel to longitudinal band 6, a bottom support block 13 extending parallel to longitudinal band 7, and a pair of opposed, spaced and parallel reinforcing walls 14 and 15 each having a wall thickness about 3 to 6 times thicker than the thickness of each frame stave side wall 9, 10. Support blocks 12 and 13 and the two reinforcing walls 14 and 15 are interconnected together into a rectangular housing of FIG. 2*b*, for example, by spot welding as at 20. The insert has a hollow cavity 3 formed between parts 12, 13, 14 and 15.

Figure 5:
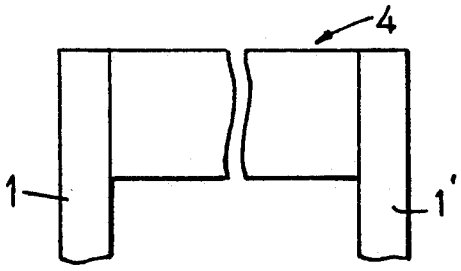
FIG. 5 is a schematic plan view of a heddle frame stave showing opposed lateral supports connected to the frame stave.

Projection 2 of lateral support 1 extends into cavity 3 of insert 11 when fully assembled as shown in FIG. 5. Upper block 12 of the insert has a threaded bore 16 for the reception of set screw 5. And, in the upper longitudinal band 6 of frame stave 4 there is a single bore 17 through which set screw 5 extends, it being recognized that the detachable corner connection shown in FIGS. 1*a* and 1*b* is repeated on the opposite end of the frame stave for lateral support 1' of FIG. 5, such that the present description of the assembly herein applies to both lateral supports 1 and 1'. Thus, clamping is carried out only in insert 11 in that each set screw extending through block 12 bears against projection 2 of the lateral support and forces the projection against bottom block 13.

Reinforcing walls 14 and 15 of the insert are securely interconnected to thin side walls 9 and 10 of the frame stave as the entirety of the confronting surfaces of the reinforcing walls and thin side walls, or at least portions thereof, are welded together although not shown in the interest of clarity. Each thin side wall of sheet metal may be expediently connected to a confronting reinforcing wall of the insert by laser welding along designated welding lines distributed over the surfaces of the thin walls. Laser welding permits the thin sheet metal and the upper and lower bands to be connected in such a manner by suitably choosing the course of the weld. The parts of insert 11 may likewise be interconnected by welding, or by rivets or by screws.

The secure connection between thin side walls 9 and 10 of the frame stave and reinforcing walls 14 and 15 of the insert can also be effected with the use of an adhesive especially if the parts of the hollow frame stave and/or of the insert are made of a fiber reinforced plastic material.

FIGS. 3*a*, 3*b*, 4*a* and 4*b* illustrate another embodiment of the invention which differs from the aforedescribed embodiment only in that the somewhat longer reinforcing walls 14 and 15 cf insert 11 extend as far as longitudinal bands 6 and 7 of the frame stave and are connected thereto. Thus, insert 11 shown in FIG. 4*b* has its blocks 12 and 13 spaced inwardly from the upper and lower edges of reinforcing walls 14 and 15 so as to define end regions **14*a* and 15*a* of the reinforcing walls that extend beyond blocks 12 and 13. These end regions are connected to longitudinal bands 6 and 7 of the frame stave as by means of a weld extending over the entire width of the reinforcing wall. To produce these welds the thin side walls 9 and 10 of the frame have at the upper and bottom edges thereof recesses 18 and 19 of approximate size to that of connection edge regions 14*a* and 15*a*. Moreover, side walls 9 and 10 of the frame stave are securely interconnected as by welding, in the same manner as described for the first embodiment, with a subarea or total area to the reinforcing walls 14 and 15 of insert 11**.

What is claimed is:

1. A heddle frame comprising a hollow frame stave and opposed lateral supports, the frame stave having a detachable corner connection between each of the supports and the frame stave, each said corner connection comprising a projection on each said support, the frame stave comprising a pair of thin, opposing and spaced side walls having opposed inner surfaces, a pair of spaced longitudinal support elements located between said side walls and connected thereto, a rigid insert provided at each said corner connection being located between said side walls, each said insert having spaced opposed reinforcing walls defining an open cavity, the projection on each of the lateral supports extending into the cavity, threaded fastener means extending through one of said support elements and bearing against each said projection for clamping each of the lateral supports to the frame stave, said reinforcing walls of each said insert being connected to the opposed inner surfaces of said thin side walls of said frame stave for transmitting pull or thrust forces generated during a weaving operation from the lateral supports to the frame stave via the thin side walls and for generating an expanded thrust area along the longitudinal direction of the support elements.

2. The heddle frame according to claim 1, wherein each said insert comprises a rectangular housing having a pair of spaced, parallel and longitudinally extending support blocks lying parallel to the support elements, said opposed reinforcing walls of each said insert being connected to said blocks, one of said blocks having a threaded borehole for the reception of said fastener means, said fastener means clamping each said projection against the other support block of each said insert.

3. The heddle frame according to claim 2, wherein portions of the reinforcing walls are welded to the thin side walls of the frame stave.

4. The heddle frame according to claim 2, wherein the thin side walls, longitudinal support elements, reinforcing walls and support blocks are of steel and are welded together.

5. The heddle frame according to claim 2, wherein the reinforcing walls and support blocks of the inserts are welded together.

6. The heddle frame according to claim 2, wherein the reinforcing walls and support blocks of the inserts are interconnected by fasteners.

7. The heddle frame according to claim 2, wherein least one of the support elements and the side walls of the frame stave and the reinforcing walls and support blocks of the inserts are of a fiber reinforced plastic material and are interconnected.

8. The heddle frame according to claim 7, wherein each of the support elements and the side walls of the frame stave and the reinforcing walls and support blocks of the inserts are of a fiber reinforced plastic material and are interconnected.

9. The heddle frame according to claim 1, wherein each said insert comprises a housing have a pair of spaced, parallel and longitudinally extending support blocks, said blocks being spaced inwardly of opposed longitudinally edges of said reinforcing walls for defining edge regions of said walls extending beyond said blocks, said edge regions being securely connected to said support elements, said side walls having recesses at said edge regions thereof for permitting the walls of the inserts to be connected to said support elements as by welding in the areas of the corner connections.

10. The heddle frame according to claim 9, wherein portions of the reinforcing walls are welded to the thin side walls of the frame stave.

* * * * *